US006903696B1

(12) United States Patent
Lee

(10) Patent No.: US 6,903,696 B1
(45) Date of Patent: Jun. 7, 2005

(54) PLANAR E-INVERTED ANTENNA

(75) Inventor: Chun-Ho Lee, Taipei (TW)

(73) Assignee: Mitac International Corp., Hsinchu (TW)

( * ) Notice: Subject to any disclaimer, the term of this patent is extended or adjusted under 35 U.S.C. 154(b) by 24 days.

(21) Appl. No.: 10/714,883

(22) Filed: Nov. 18, 2003

(51) Int. Cl.[7] ..... H01Q 1/24
(52) U.S. Cl. ..... 343/702; 343/700 MS
(58) Field of Search ..... 343/702, 700 MS, 343/846; 455/90

(56) References Cited

U.S. PATENT DOCUMENTS 6,025,805 A 2/2000 Smith et al. ..... 343/702

6,448,933 B1 9/2002 Hill et al. ..... 343/702

*Primary Examiner*—Hoang V. Nguyen
(74) *Attorney, Agent, or Firm*—Birch, Stewart, Kolasch & Birch, LLP

(57) ABSTRACT

A planar E-inverted antenna comprises a signal line connecting to a signal source for feeding a voltage signal; first and second short-circuit ends respectively connecting to a grounding area for outputting the voltage signal to the grounding area; and a radio-frequency area, being supported over the grounding area by means of the first and second short-circuit ends. The radio-frequency area and the grounding area have approximately a same length so that a signal is corresponded in radio-frequency to the length of the radio-frequency area and an electromagnetic wave of the corresponding frequency is received from the outside, the corresponded signal traveling to the grounding area via the short-circuit ends.

4 Claims, 7 Drawing Sheets

RADIATION PATTERN IN THE E-PLANE OF A PLANAR F-INVERTED ANTENNA PLACED HORIZONTALLY

RADIATION PATTERN IN THE H-PLANE OF A PLANAR F-INVERTED ANTENNA PLACED VERTICALLY

RADIATION PATTERN IN THE H-PLANE OF A PLANAR E-INVERTED ANTENNA PLACED HORIZONTALLY

RADIATION PATTERN IN THE E-PLANE OF A PLANAR E-INVERTED ANTENNA PLACED VERTICALLY

PLANAR E-INVERTED ANTENNA

BACKGROUND OF THE INVENTION

1. Field of Invention

The present invention relates to a planar antenna structure, and more particularly to a planar E-inverted antenna structure.

2. Related Art

An antenna structure is usually used to transmit and receive electromagnetic waves. To this purpose, specific designs are usually required to be able to irradiate signals in electromagnetic waveforms of radio frequency from the transmitter through the air medium, and/or to intercept electromagnetic waves carried by air media and convert it to meaningful radio-frequency signals. Antenna design is therefore an important in the actual performance of wireless equipment.

Presently, planar F-inverted antennae are known in the art, called like this because of its F-inverted shape. The operating length of the planar F-inverted antenna is only about $\lambda/4$, while that of the grounding area is $\lambda/2$. On the other hand, because the planar F-inverted antenna only uses a metallic conductor in association with adequate feeding and antenna short-circuits to the grounding area, its manufacturing cost is relatively low, and it can be soldered to the printed circuit board.

FIG. 1 illustrates a planar F-inverted antenna known in the art. The known antenna includes an open-circuit area 11, a short-circuit end 12, and a grounding area 13. A signal line 14 connects the open-circuit area 11 to the grounding area 13. A radio-frequency signal travels via the signal line 14 to the open-circuit area 11, or from the open-circuit area 11 to the signal line 14. With the short-circuit end 12 connected to the grounding area 13, signals therefore travel from the open-circuit area 11 via the short-circuit end 12 to the grounding area 13.

The metallic conductor of the planar F-inverted antenna of the prior art can be either in a linear shape or flat shape. In FIG. 1, the metallic conductor is in a flat plate shape, and thereby can be soldered on the printed circuit board as a surface-mount device, being thereby used as a concealed type antenna.

To support the metallic conductor, e.g. the open-circuit area 11 in a manner not to short-circuit the grounding area 13, an insulating material 15 such as sponge material is usually inserted between the open-circuit area 11 and the grounding area 13 to support the open-circuit area.

Some problems may occur when a sponge material is used to support the open-circuit area 11 in the planar F-inverted antenna. The sponge or insulating material can absorb electromagnetic waves so that signal loss occurs at the transmission and reception. The antenna gain therefore is decreased. If sponge materials are used as support, additional and specific processing steps are needed, which increases manufacturing costs. As shown in FIG. 4, when the antenna is placed in a horizontal position, the radiation pattern further exhibits a central recessed area, and the radiation pattern therefore is not satisfactory. In addition, if the antenna has a baseband frequency f, its next harmonic is 3f, which is not suitable for double-baseband use, such as 900 MHz and 1800 MHz.

SUMMARY OF THE INVENTION

It is therefore an objective of the invention to provide a planar E-inverted antenna structure that can overcome the above problems of the prior art.

To achieve the above and other objectives, a planar E-inverted antenna structure of the invention comprises a radio-frequency area, first and second short-circuits ends, and a grounding area. A signal line connects the radio-frequency area to the grounding area, the signal line being connected to a signal source. The radio-frequency signal, e.g. a voltage, travels from the signal line to the radio-frequency area, or from the radio-frequency area to the signal line.

The connection of the first and second shot-circuit ends to the grounding area enables to support the radio-frequency area over the grounding area to change the antenna characteristics. The radio-frequency area and the grounding area have approximately the same length so that the operating length of the antenna is about $\lambda/2$.

T he planar E-inverted antenna according to the invention does not occupy a larger area than the planar F-inverted antenna, and further has a next resonance frequency which is doubled, which makes the antenna of the invention particularly suitable for use in double-baseband configuration. Due to different directions of polarization, more flexibility in utilization is offered.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

The present invention describes a planar E-inverted antenna structure, which has a side in an "E" inverted shape.

Figure 2:
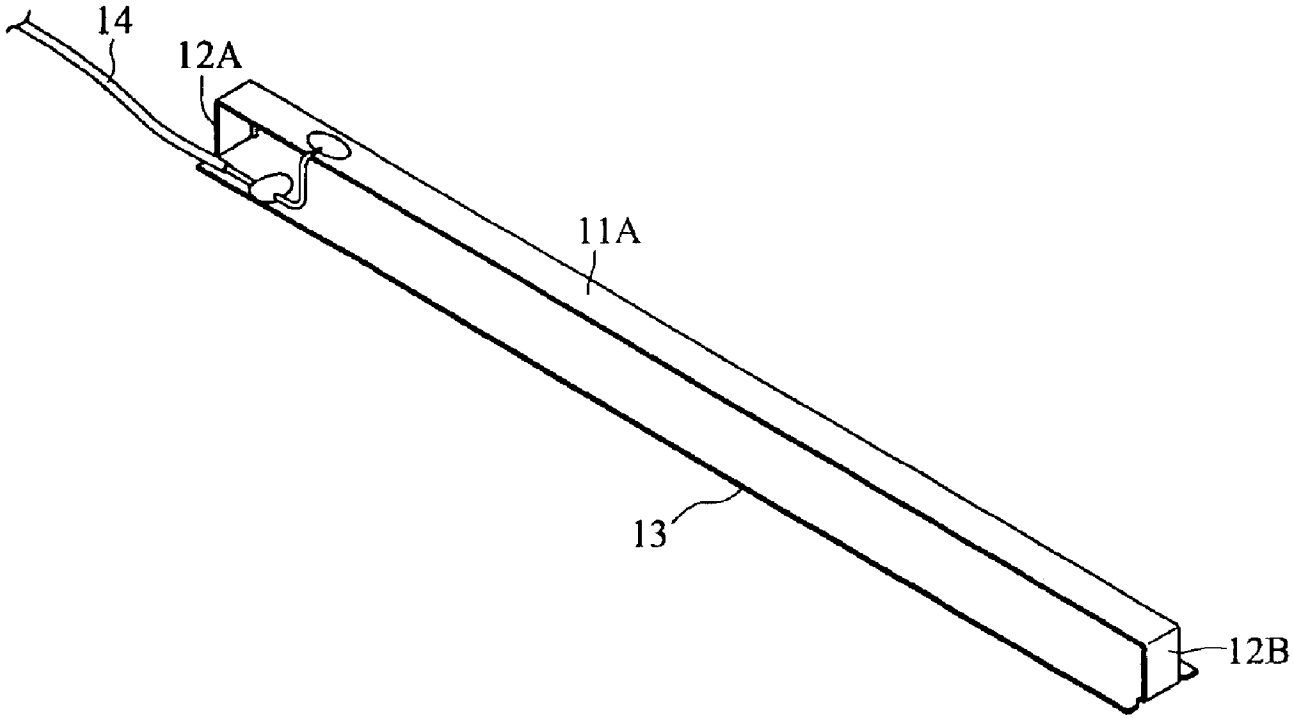
FIG. 2 is a schematic view of a planar E-inverted antenna according to an embodiment of the invention.

Referring to FIG. 2, the planar E-inverted antenna of the invention includes a radio-frequency area 11A, first and second short-circuit ends 12A, 12B, and a grounding area 13. A signal line 14 coupled with a signal source connects the radio-frequency area 11A to the grounding area 13. A radio-frequency signal (i.e. voltage) travels either from the signal line 14 to the radio-frequency area 22A, or from the radio-frequency area 11A to the signal line 14.

The connection of the first and second short-circuit ends 12A, 12B to the grounding area 13 enables to support open-circuit area 11 over the grounding area 13, and further changes the antenna characteristics. The antenna structure therefore does not need a sponge material to achieve support function, the support member formed along with the formation of the short-circuit ends. As a result, the manufacturing process is simplified, and production costs are reduced.

As shown, the open-circuit area 11 and the grounding area 13 have approximately the same length, and the operating length of the antennae is about λ/2.

Figure 1:
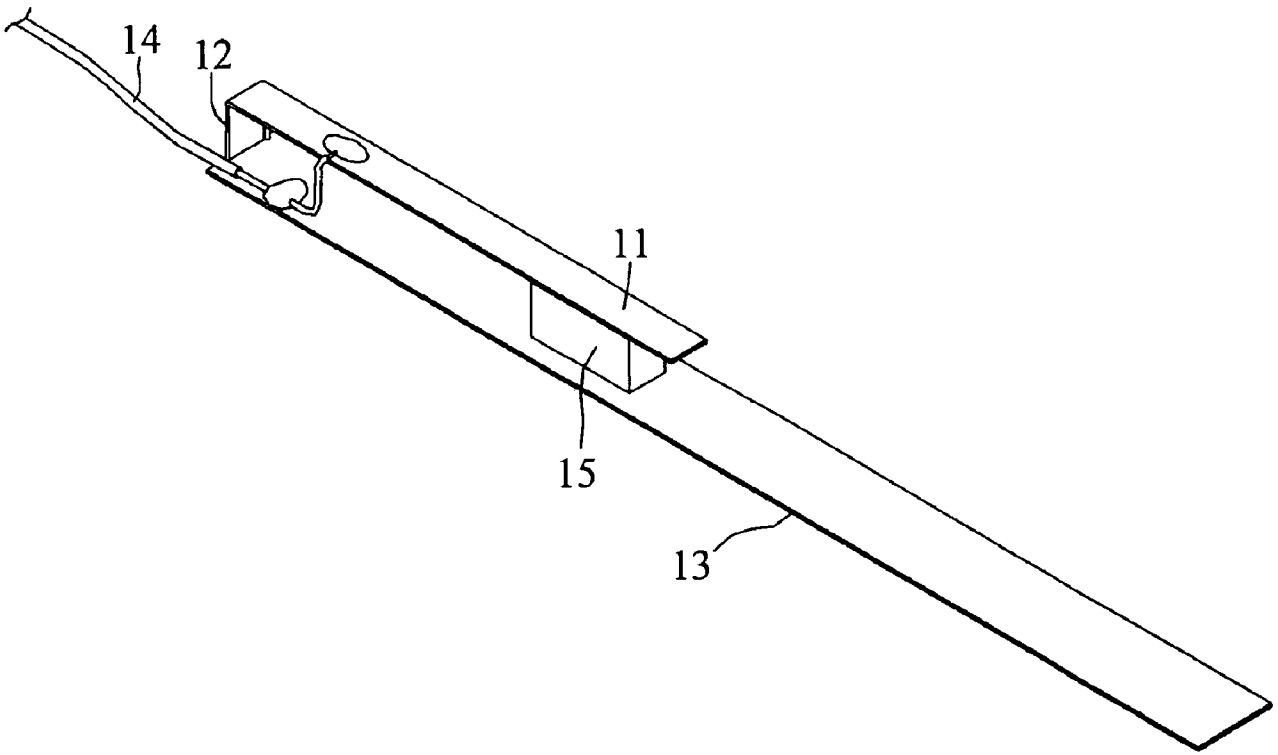
FIG. 1 (PRIOR ART)
FIG. 1 is a schematic view of a conventional planar F-inverted antenna.

In comparison with the conventional structure as shown in FIG. 1, the embodiment of the invention does not have one short-circuit part directly connecting to the grounding area at the right side of the radio-frequency area 11A (in the direction of the figure). Such a design will negatively double the baseband of the radio-frequency area, which renders the antenna use incompatible with the associated product.

Therefore, a design in which first and second short-circuit ends 12A, 12B are connected to the grounding area 13 enables to obtain a baseband similar to that of the original PIFA antenna. Other parts described in the drawings are used to illustrate various uses of the antenna structure of the invention, and therefore should not be construed in a manner to limit the scope of the invention.

Figure 4:
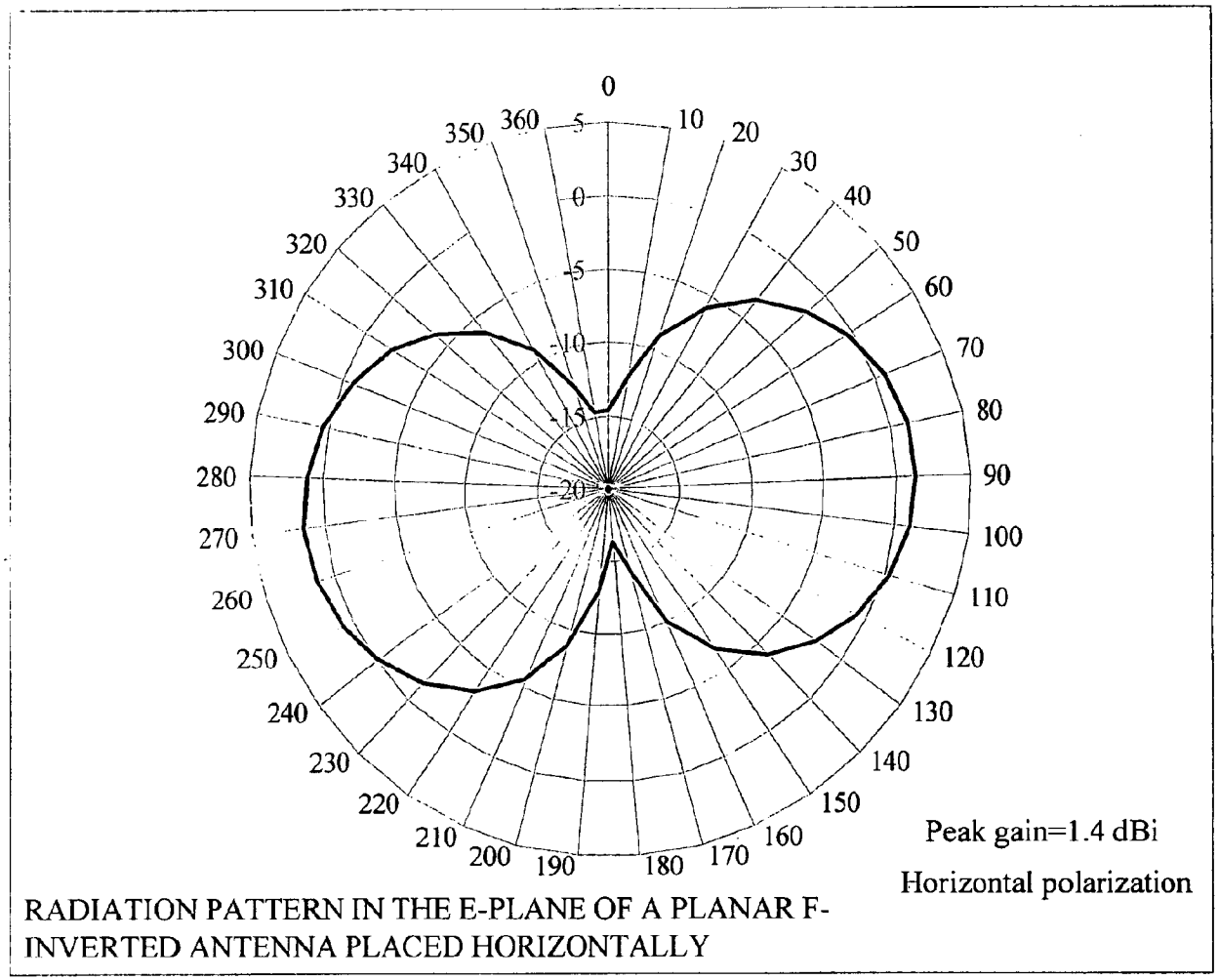
FIG. 4 is a schematic diagram illustrating the radiation pattern in the E-plane of a conventional planar F-inverted antenna being placed in horizontal position.
Figure 6:
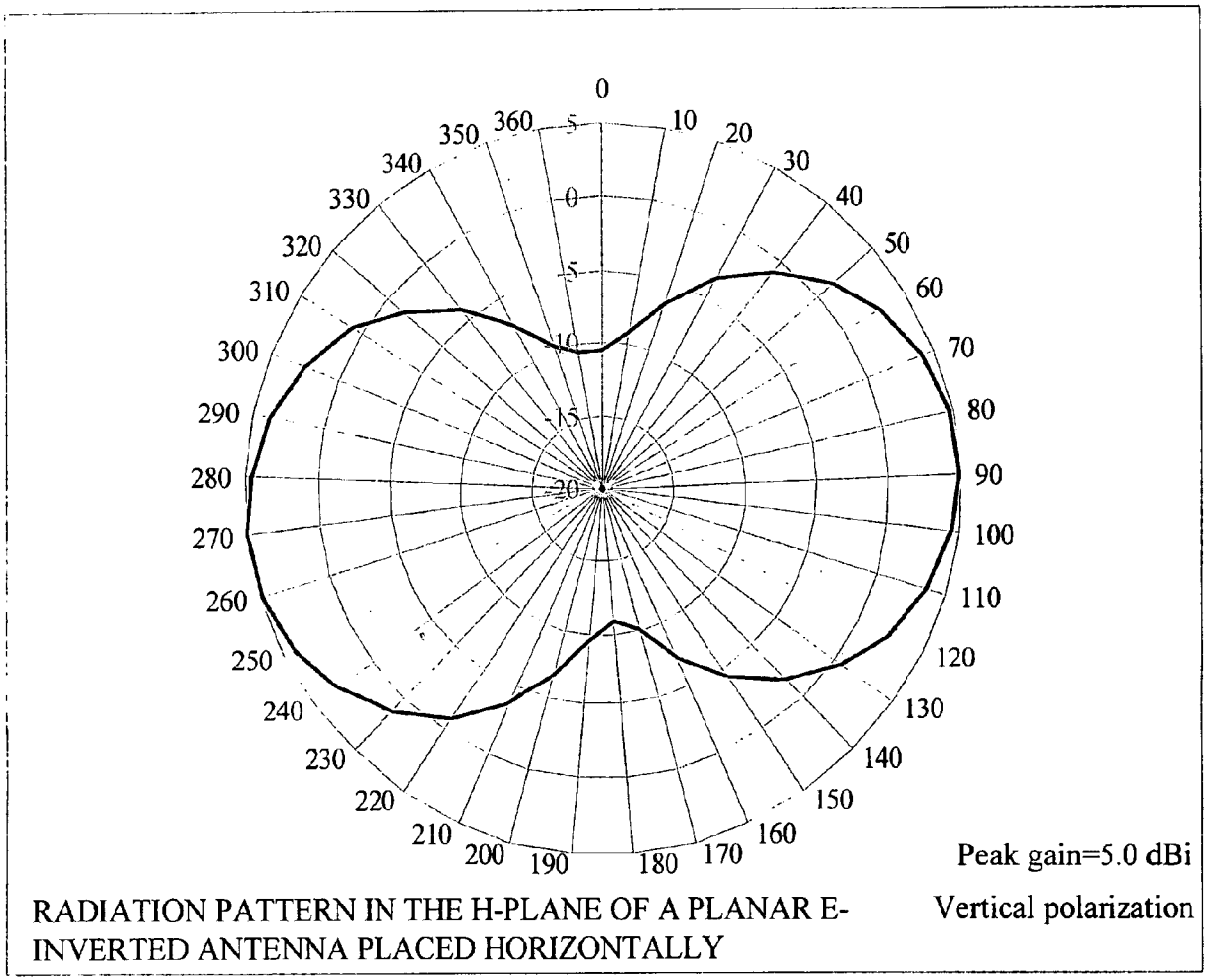
FIG. 6 is a schematic diagram illustrating the radiation pattern in the H-plane of a planar E-inverted antenna according to the invention being placed in horizontal position.

Besides improving the manufacturing process, the planar E-inverted antenna of the invention provides better performance, compared to the conventional planar F-inverted antenna. FIG. 6 is a schematic diagram illustrating the radiation pattern in the H-plane of the planar E-inverted antenna of the invention, the antenna being placed in a horizontal position. The antenna then has a vertical direction of polarization. In contrast, FIG. 4 is a schematic diagram of the radiation pattern in the E-plane of a conventional planar F-inverted antenna, being placed in a horizontal position. The conventional antenna is hence placed has a horizontal direction of polarization. A comparison between both radiation pattern diagrams shows that the recessed portion of the radiation pattern exhibited by the planar F-inverted antenna is substantially improved in the planar E-inverted antenna of the invention. Furthermore, a gain increase can be observed. These results show that the antenna structure of the invention has better performance. Furthermore, the direction of polarization of the antenna structure according to the invention is the inverse of that of the planar F-inverted antenna.

Figure 5:
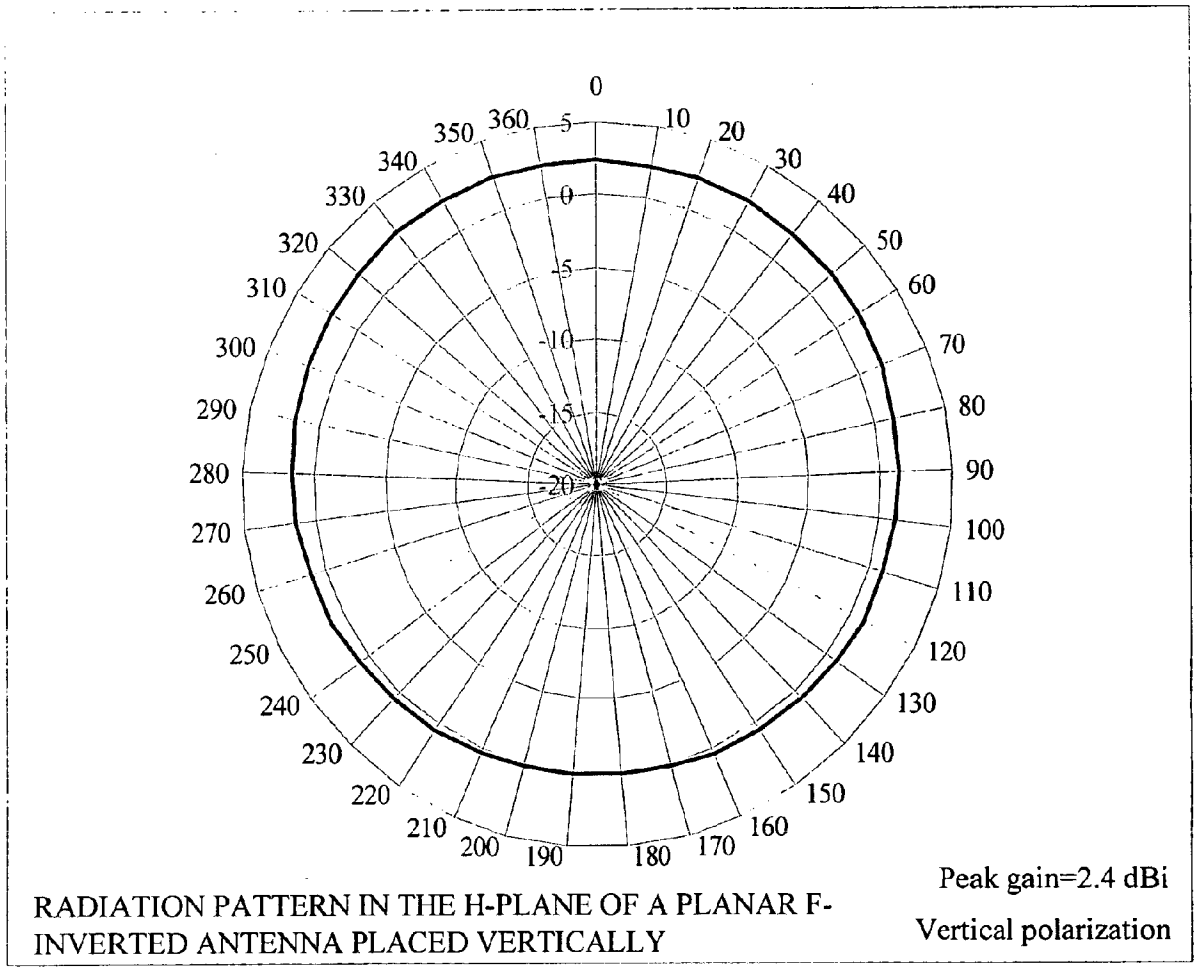
FIG. 5 is a schematic diagram illustrating the radiation pattern in the H-plane of a conventional planar F-inverted antenna being placed in a vertical position.
Figure 7:
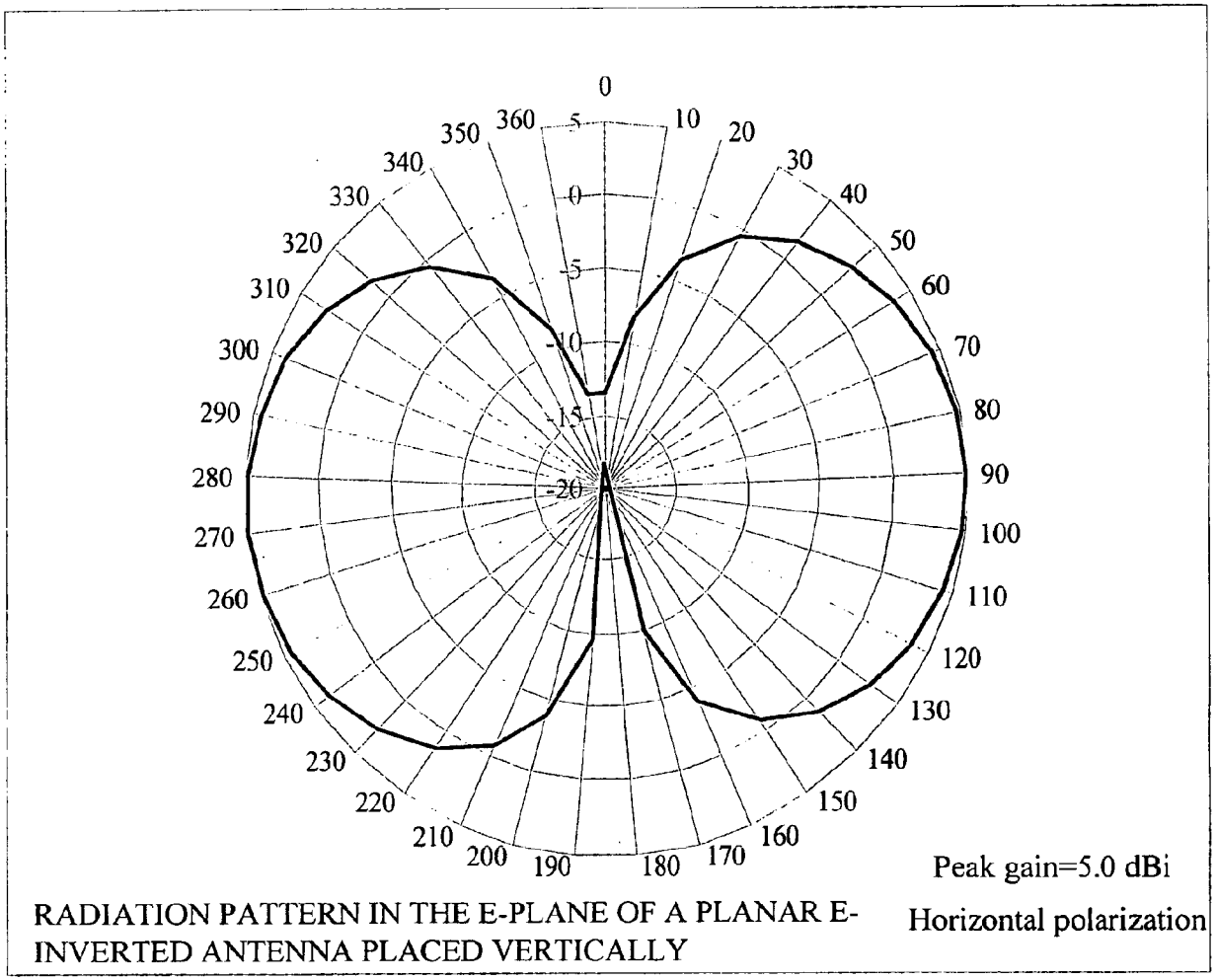
FIG. 7 is a schematic diagram illustrating the radiation pattern in the E-plane of a planar E-inverted antenna according to the invention being placed in vertical position.

FIG. 7 is a schematic diagram illustrating the radiation pattern in the E-plane of the planar E-inverted antenna of the invention, the antenna being placed in a vertical position. The direction of polarization is horizontal. In contrast, FIG. 5 is a schematic diagram illustrating the radiation pattern in the H-plane of the conventional planar F-inverted antenna, the antenna being placed in a vertical position. As shown, the direction of polarization for the conventional F-inverted planar antenna is vertical. The above observation shows that regardless of whether they are placed in a vertical or horizontal position, the planar E-inverted antenna and the planar F-inverted antenna have different polarization directions. This provides a flexible and advantageous use of the antenna in various situations. For example: when the antenna in use can be disposed in only one position (either horizontal or vertical), which is the case for a concealed type antenna, and the direction of polarization has to be in the direction different from that of the antenna placement to obtain optimal reception, the planar E-inverted antenna is more advantageous than the planar F-inverted antenna and provides an increased gain.

Figure 3:
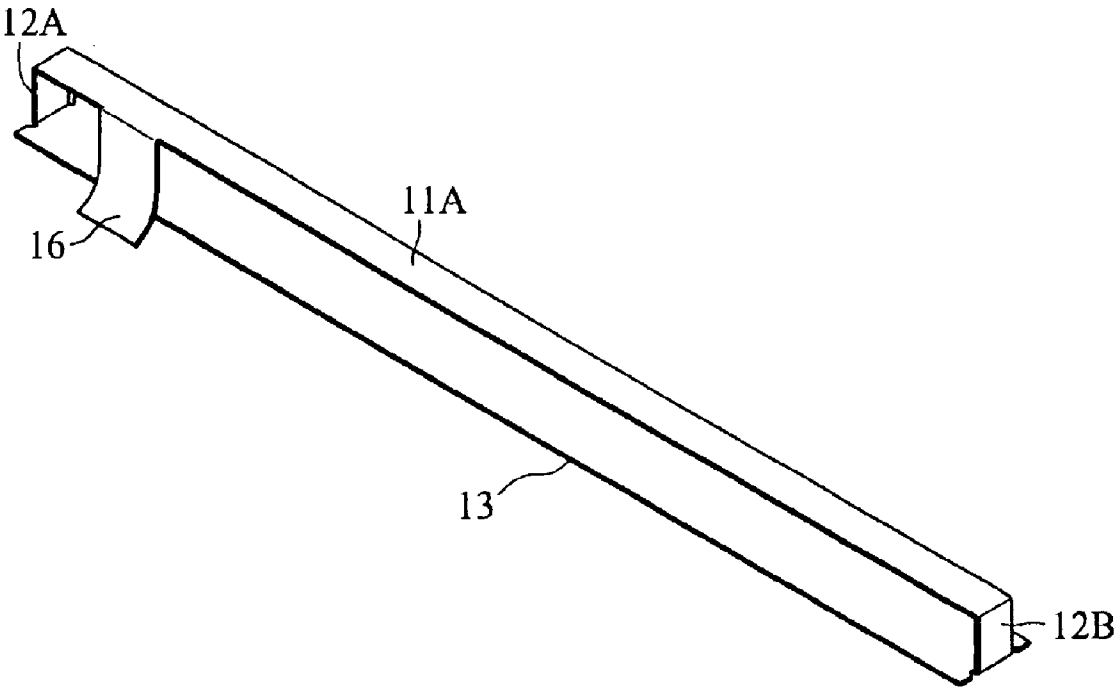
FIG. 3 is a schematic view of a planar E-inverted antenna according to a second embodiment of the invention.

FIG. 3 illustrates a second embodiment of the invention. In this second embodiment, the planar F-inverted antenna is directly soldered on the printing circuit board, and includes the radio-frequency area 11A, first and second short-circuits ends 12A, 12B, and the grounding area 13. A feeding portion 16 connects to the radio-frequency area 11A. A radio-frequency signal (voltage) is fed from a radio-frequency output of the printing circuit board and travels via the feeding portion 16 to the radio-frequency area 11A or vice-versa from the radio-frequency area 11A via the feeding portion 16 to the radio-frequency output of the printing circuit board.

The connection of the first and second short-circuit ends 12A, 12B to the grounding area 13 enables to support open-circuit area 11 over the grounding area 13, and further changes the antenna characteristics. The antenna structure therefore does not need a sponge material to achieve support function, the support member being formed along with the formation of the short-circuit ends. As a result, the manufacturing process is simplified, and the production cost is reduced.

As shown, the open-circuit area 11 and the grounding area 13 have approximately the same length, and the operating length of the antenna is about λ/2.

The planar E-inverted antenna of the invention does not occupy a larger area than the planar F-inverted antenna of the prior art, and further has a next resonance frequency which is doubled, which makes the antenna of the invention particularly suitable for use in double-baseband configuration. Owing to different directions of polarization, more flexibility is therefore offered.

Via a structural modification, the planar E-inverted antenna of the invention is more convenient and economical to manufacture, and has a modified direction of polarization, as a result it has better transmission and reception performance. In addition to an advantageous reduction in size, no extra fixation elements are further needed, and the maximum surface area of the structure can be used, while the gain is increased.

It will be apparent to the person skilled in the art that the invention as described above may be varied in many ways, and notwithstanding remaining within the spirit and scope of the invention as defined in the following claims.

What is claimed is:

1. A planar E-inverted antenna, comprising:

a signal line, connecting to a signal source for feeding a voltage signal;

first and second short-circuit ends, respectively connecting to a grounding area for outputting the voltage signal to the grounding area; and a radio-frequency area, being supported over the grounding area by means of the first and second short-circuit ends, wherein the radio-frequency area and the grounding area have approximately a same length so that a signal is corresponded in radio-frequency to the length of the radio-frequency area and an electromagnetic wave of the corresponding frequency is received from the outside, the corresponded signal traveling to the grounding area via the short-circuit ends.

2. The antenna structure of claim 1, wherein the radio frequency of the radio-frequency area is λ/2.

3. A planar E-inverted antenna, comprising:

a feeding portion, connecting to a signal source for feeding a voltage signal;

first and second short-circuit ends, respectively connecting to a grounding area for outputting the voltage signal to the grounding area; and a radio-frequency area, being supported over the grounding area by means of the first and second short-circuit ends, wherein the open-circuit area and the grounding area have approximately a same length so that a voltage signal is corresponded in radio frequency to the length of the open-circuit area and an electromagnetic wave of the corresponding frequency is received from the outside, the voltage signal traveling to the grounding area via the short-circuit ends.

4. The antenna structure of claim 3, wherein the radio frequency of the radio-frequency is $\lambda/2$.

* * * * *